United States Patent [19]

Cappello

[11] Patent Number: 4,866,882

[45] Date of Patent: Sep. 19, 1989

[54] STAND-OUT WINDOW OPENING MECHANISM

[76] Inventor: Emanuel J. Cappello, 7769 E. Camelback Rd. #250, Scottsdale, Ariz. 85251

[21] Appl. No.: 187,924

[22] Filed: Apr. 29, 1988

[51] Int. Cl.[4] ..... E05F 11/00

[52] U.S. Cl. ..... 49/324; 49/193; 49/342

[58] Field of Search ..... 49/83, 324, 342, 193

[56] References Cited

U.S. PATENT DOCUMENTS

| | | | |
|---|---|---|---|
| 163,113 | 5/1875 | Starrett . | |
| 203,123 | 4/1878 | Deblois . | |
| 321,266 | 6/1885 | Whitney . | |
| 371,245 | 10/1887 | Barber . | |
| 428,624 | 5/1890 | Morrell . | |
| 441,943 | 12/1890 | De Kalb . | |
| 490,244 | 1/1893 | Craigie . | |
| 497,296 | 5/1893 | Barber . | |
| 531,244 | 12/1894 | Abbott et al. . | |
| 2,374,618 | 4/1945 | Perreton . | |
| 2,637,547 | 5/1953 | Schottenberg | 49/83 X |
| 2,709,582 | 5/1955 | Chapman | 49/83 X |
| 4,617,758 | 10/1986 | Vetter | 49/324 |

FOREIGN PATENT DOCUMENTS

| | | | |
|---|---|---|---|
| 139011 | 2/1920 | United Kingdom | 40/324 |

*Primary Examiner*—James R. Brittain

*Attorney, Agent, or Firm*—LaValle D. Ptak

[57] ABSTRACT

A window opening mechanism is disclosed which moves the entire window sash outwardly from the window frame in a plane parallel to the plane of the frame. The mechanism for accomplishing this includes a pair of pivoted L-shaped lever arms on each side of the window. The short legs of these lever arms are substantially shorter than the long legs, and the ends of the short legs are pivotally attached to the window frame relatively close together. An operating mechanism is provided for moving the elbows of the lever arms toward and away from one another, and the ends of the long legs of the arms are pivotally connected at spaced apart points on the window sash. As the elbows of the levers on both sides are moved toward one another, the window sash is pulled toward the frame. When the elbows are moved away from one another, the pivoting action of the lever arms causes the window sash to be moved outwardly from the frame to provide a "stand-out" opening of the window.

10 Claims, 2 Drawing Sheets

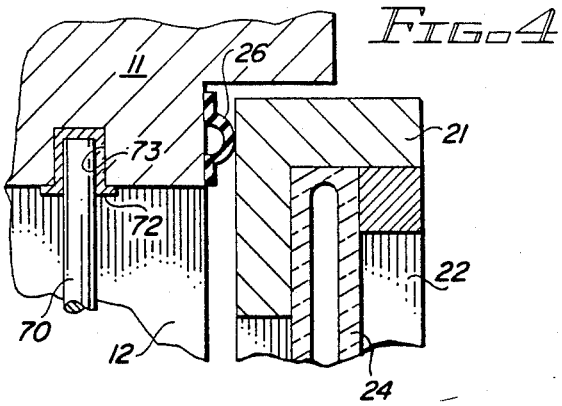
FIG. 4
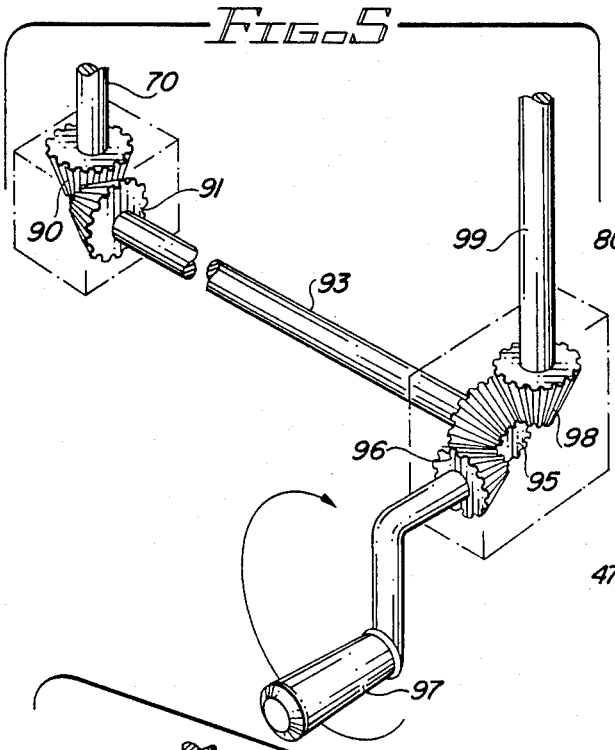
FIG. 5
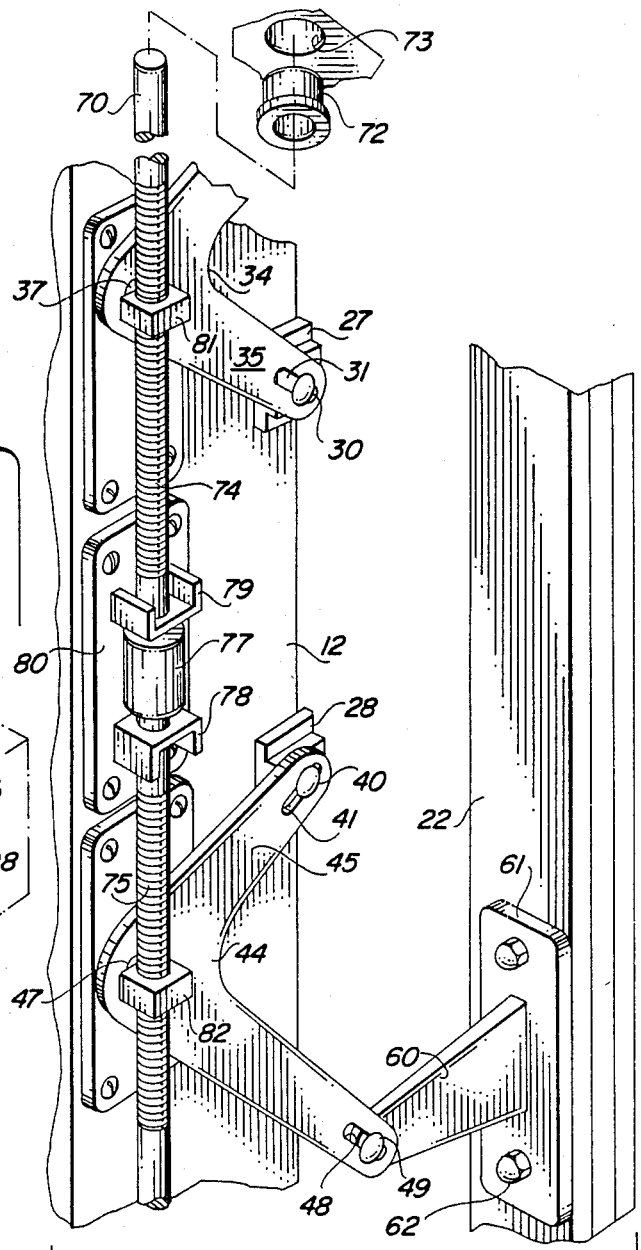
FIG. 6
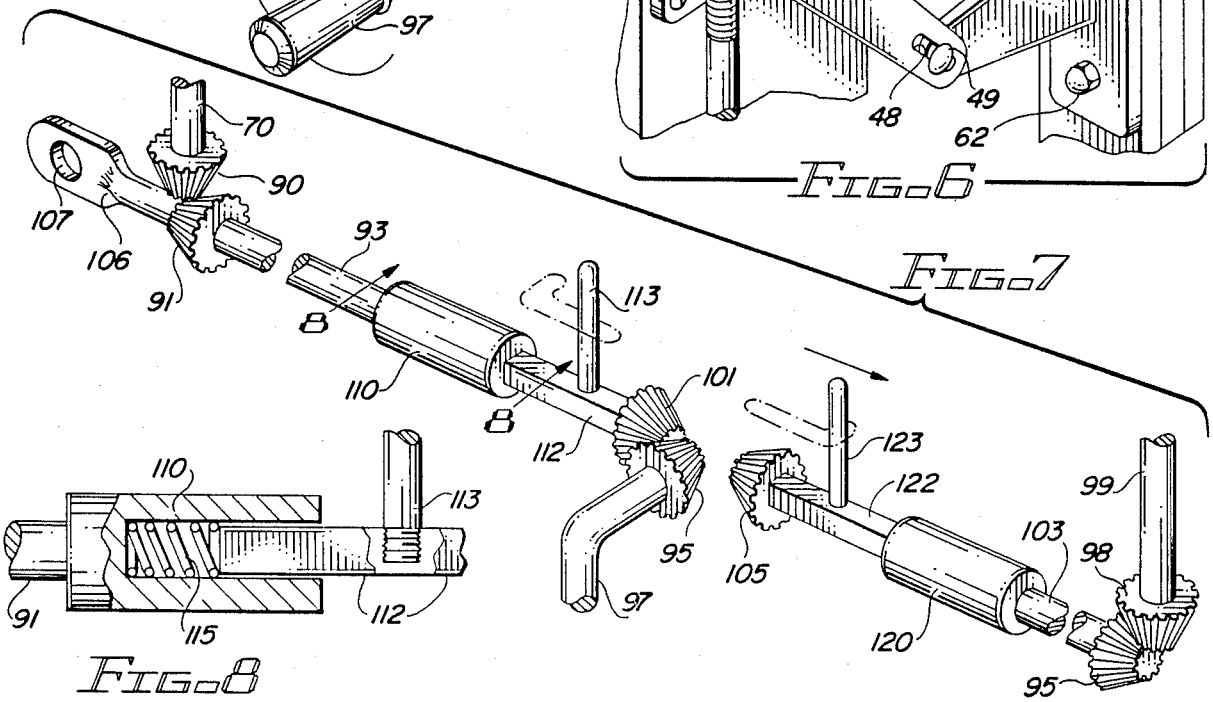
FIG. 7
FIG. 8

STAND-OUT WINDOW OPENING MECHANISM

BACKGROUND

In the construction of both commercial buildings and homes, windows are an important architectural and functional feature. The primary use of windows in buildings of all types is to admit light and to permit occupants of the building to see the building surroundings through the window. An extremely important secondary purpose, is to use windows for the purpose of providing ventilation to the building interior. This is quite common in homes and apartment buildings. Many office buildings, however, currently are constructed with sealed windows which are incapable of being opened. In such office buildings, all ventilation necessarily is controlled by air handling equipment in conjunction with refrigeration and heating units.

In building construction where the windows are capable of being opened fully or partially, a variety of different techniques typically are employed. For residential use, "double-hung" windows are in relatively widespread use, particularly in colder climates. Double-hung windows are constructed with the upper half of the window either permanently in place or installed on a first pair of vertical tracks for vertical movement. The lower portion of the window is installed on a second pair of tracks, parallel to the tracks for the upper half, for vertical movement in a plane parallel to the plane of the upper half of the window. Consequently, the maximum window opening at any time is one-half of the total window frame area; and this opening is provided when either the top half is pulled all the way down or the bottom half is lifted all the way up to its maximum position. There are intermediate positions of both the top and bottom portions of the window which may be used to provide varying amounts of ventilation.

Another type of window which is capable of opening a greater portion of the window frame area for ventilation is a casement window. Such windows typically are hinged at the top and bottom at one side of the frame, and a crank mechanism is used to swing the window toward and away from the window frame opening. When the window is pivoted to a position in a plane substantially 90° to the plane of the frame opening, the entire frame area is open to permit ventilation. Again, varying degrees of opening are provided by pivoting the window outwardly at different angles from the fully closed position to the fully opened position. When the window is open to its more extended positions, however, considerable stress is produced on the operating hardware in the event winds of any substantial amount blow against the extended window.

In some parts of the country, horizontal sliding windows, which move in tracks across the window opening (as contrasted to double-hung windows which move vertically) are used. The structure for such sliding windows is relatively simple, and these windows are among the most inexpensive to build and install. Sliding windows are extensively used in moderate climates; and when such windows are in their "fully open" position, one-half of the window opening encompassed by the window frame is open for ventilation.

In all of the window constructions mentioned above, ventilation may be provided; but when such windows are used in a large building, such as an apartment building, the aesthetic appearance of the building is significantly affected by the different window positions of the windows in different apartments or rooms of the building. For example, some windows will be fully closed, with the window lines provided by the frames and the window sashes producing the aesthetic effect envisioned by the architect in the original building design. Whenever any of the windows of the types mentioned above, however, are open or partially open in any of the other rooms of the building, the architectural lines are broken or interrupted in varying amounts depending upon the position of the window sash.

In addition to significantly altering the aesthetic appearance of the building, whenever any of the windows of the above type are open to any great extent, the security of the building is significantly impaired since the window opening provides ready access for entry. Consequently, when security is a concern, the windows must be closed and locked or opened only a slight amount and locked in place to prevent unauthorized entry into the building through the window opening. Partially opened windows provide significantly less ventilation than a widely opened window, as is readily apparent.

In an effort to overcome the disadvantages of the standard window sash opening constructions discussed above, some attempts have been made to provide a "stand-out" type of window opening. Stand-out window opening is achieved by moving the entire window and window sash outwardly from the window frame in a plane parallel to the opening in the window frame. One patent disclosing such a construction is the Perreton U.S. Pat. No. 2,374,618. The window structure disclosed in this patent has the sash mounted on opposite vertical edges to a scissors lever structure, the other portion of which is mounted in the frame. The window then is moved outwardly by means of a handle attached to one of the legs of the scissors mechanism to cause it to move from a fully closed position to a "stand-out" position located a few inches away from the frame opening. The scissors mechanism, however, is relatively bulky and cumbersome.

Two other patents which disclose systems for providing limited movement of the entire window sash outwardly in a plane parallel to the plane of the window frame, are the Barber U.S. Pat. No. 497,296 and Abbott U.S. Pat. No. 531,244. The Barber Patent uses another variety of a scissors type lever arm mechanism which requires a relatively thick wall or window frame to accomodate the mechanism. The mechanism itself also employs long intersecting lever arms mounted at the side of the window frame for effecting the motion of the sash relative to the frame. Because of the nature of the construction, the frame thickness or wall thickness for holding the operating mechanism must be equal to the maximum outward movement of the window sash.

The Abbott Patent discloses a window mechanism using a crank and rack gear for operating an eccentric mechanism for controlling the outward movement of the window. For a mechanism having parts of reasonably small size, only very limited outward movement of the window sash is possible with the structure of this device.

An advantage to "stand-out" window opening mechanisms, however, is that when the window is partially or fully opened, the architectural features of the building in which the window is placed, are not altered. All of the horizontal and vertical lines of the window sash and window opening are in the same orientation as when the window is fully closed. This is to be contrasted with sliding windows and double-hung windows where the window must be fully open or fully closed in order not to change the lines of the building. This is a significant advantage over casement windows which pivot outwardly to drastically change the appearance of any building in which they are used.

In addition to the architectural aesthetic advantage noted above for "stand-out" windows, such windows also are capable of providing significant ventilation with a relatively small amount of movement, due to the fact that the windows are open on all four sides to admit air into the building or exhaust air from the building. Consequently, a window which moves outwardly only a small number of inches is capable of providing the same ventilation as a double-hung window in its fully open position.

It is desirable to provide a window opening mechanism which provides the advantages of a "stand-out" window opening, but which is not subject to the disadvantages of the cumbersome operating mechanisms of the prior art.

SUMMARY OF THE INVENTION

Accordingly, it is an object of this invention to provide an improved window opening mechanism.

It is an additional object of the invention to provide an improved stand-out window opening mechanism.

It is another object of this invention to provide an improved window operating mechanism for moving a window sash outwardly from the window frame in a plane parallel to the plane of the window frame.

It is a further object of this invention to provide a simple and compact window opening mechanism for opening a window by moving the window sash in a direction perpendicular to the plane of the window frame.

In accordance with a preferred embodiment of the invention, a window opening mechanism is provided for moving a window sash outwardly from a window frame in a plane substantially parallel to the plane of the frame. The mechanism includes a pair of L-shaped lever members, each having one relatively short leg and one substantially longer leg connected together at an elbow. The lever members are mounted in the window frame with the ends of the short legs pivotally connected relatively close together to the frame. The elbows extend inwardly toward the room opening and are attached to a drive mechanism which moves the elbows toward and away from one another along a straight line. The longer legs of the lever members extend away from one another, and the ends of the longer legs are pivotally connected to the window sash. As the elbows of the lever members are moved away from one another, the lever members pivot to move the window sash outwardly from the frame. When the elbows are moved toward one another, the window sash is pulled toward the window frame.

A second set of lever members along with an additional drive mechanism is mounted on the opposite side of the window frame and the opposite edge of the window sash to provide parallel movement of the window sash relative to the window frame when the drive mechanisms on both sides of the window are operated.

BRIEF DESCRIPTION OF THE DRAWINGS

FIG. 4 is an enlarged detail of the portion circled at the top of FIG. 1;

FIG. 5 is a perspective diagrammatic representation of a drive mechanism which may be used to operate the embodiment of FIGS. 1 through 3;

FIG. 6 is a detailed perspective view illustrating the operating mechanism of the embodiment of FIGS. 1 through 3;

FIG. 7 is a diagrammatic perspective view of another embodiment of operating mechanism which may be employed in conjunction with the apparatus of FIGS. 1 through 4 and 6; and FIG. 8 shows a detail of a protion of the apparatus of FIG. 7.

DETAILED DESCRIPTION

Reference now should be made to the drawings in which the same reference numbers are used throughout the different figures to designate the same components. Initially, reference should be made to FIGS. 1 through 4 and 6 for an understanding of the window opening mechanism used to provide the stand-out opening of the window sash of a preferred embodiment of the invention.

As illustrated in FIGS. 1 through 6, a preferred embodiment of the invention has a window sash and the window opening mechanism for the window mounted in a rectangular window frame including top and bottom frame members 10 and 11 (shown in cross-section in FIGS. 1 and 2) and a pair of vertical side frame members, one of which, member 12, is shown.

It is to be understood that an identical vertical member similar to the member 12 is placed on the other side of the window frame. Since this simply is a duplication of the apparatus shown in FIGS. 1 through 6, however, an illustration of the other side of the window frame is not considered necessary.

Figure 1:
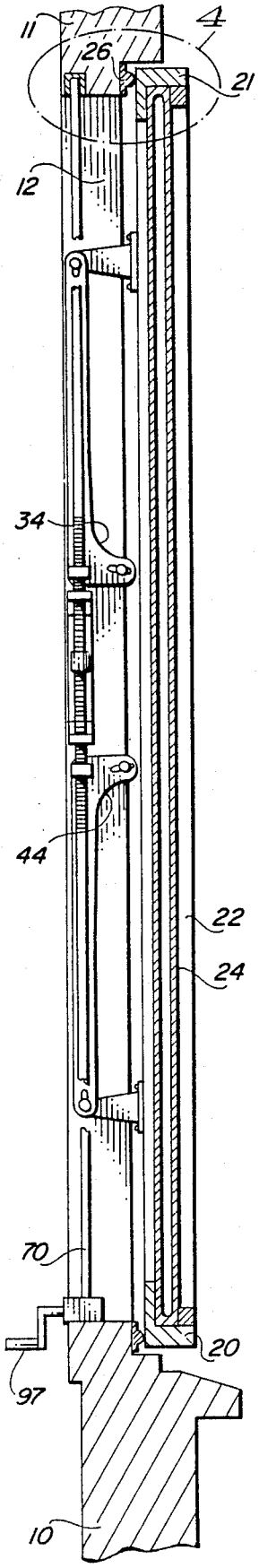
FIG. 1 is a partially cut-away side view of a preferred embodiment of the invention, showing a window in its closed position.
Figure 2:
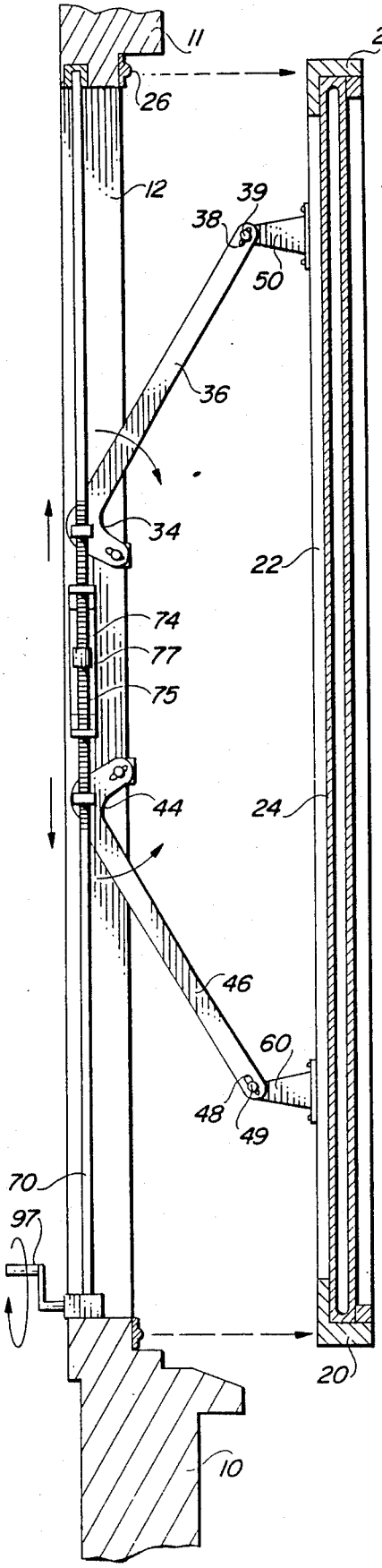
FIG. 2 is a partially cut-away side view of the embodiment of FIG. 1 showing the window mechanism in its open position.

A rectangular window sash, including horizontal bottom and top members 20 and 21 (shown in cross-section in FIGS. 1 and 2) and a pair of vertical side members, the side member 22 of which is shown in FIGS. 1 and 2, is used to hold a pane of window glass 24. The glass 24 is mounted in the window sash in any conventional suitable manner. As shown in FIG. 1, in the closed position the window sash 21 and 22 rests against a resilient seal 26 which is placed around the periphery of the opening in the window frame. Consequently, when the window is closed as shown in FIG. 1, the sash is sealed tightly against the frame 10, 11 and 12 to prevent both moisture and air from leaking around the sash into the interior of the building in which the window frame is located.

FIG. 2 illustrates the window in its open position, extended directly outwardly from the opening in the frame to place the window sash and the window located in it in a plane parallel to the plane of the window frame, but spaced outwardly from it.

When the window is in the open position shown in FIG. 2, air flow passes around all four sides of the window sash to move into and out of the opening in the frame 10, 11 and 12. For a typical window in a home or residential dwelling, the distance the window sash 20, 21, 22 may be moved outwardly from the closed position of FIG. 1 typically is from six to eight inches. An outward movement of approximately seven inches of the window sash 20, 21, 22 provides the same amount of air flow through the frame opening as is obtained from a fully opened double-hung or sliding window. The distance between the window sash and the frame, however, is insufficient to permit an intruder to enter the building through the open window without breaking the window or the operating mechanism for it. Consequently, substantially greater security exists with the stand-out window shown in FIGS. 1 and 2 than exists for fully or partially open sliding or double-hung windows.

FIGS. 3 through 6 illustrate in greater detail the mechanism which is used to move the window sash between its closed and opened positions shown in FIGS. 1 and 2. The opening mechanism for the window comprises a pair of identical L-shaped operating levers 34 and 44. These levers are mounted in a mirror image relationship to one another, as shown most clearly in FIGS. 1 and 2, and are asymmetrical with short legs 35 and 45 joined to long legs 36 and 46, respectively, at an elbow. The ends of the short legs 35 and 45 are pivotally attached to a pair of mounting blocks 27 and 28 attached to the vertical frame member 12 of the window frame. Pivots 30 and 40 extend through elongated slots 31 and 41, respectively, in the ends of the lever arms to permit these arms to pivot and to slide along the slots 31 and 41 as the operating mechanism is moved between the closed and open positions and back again.

Figure 3:
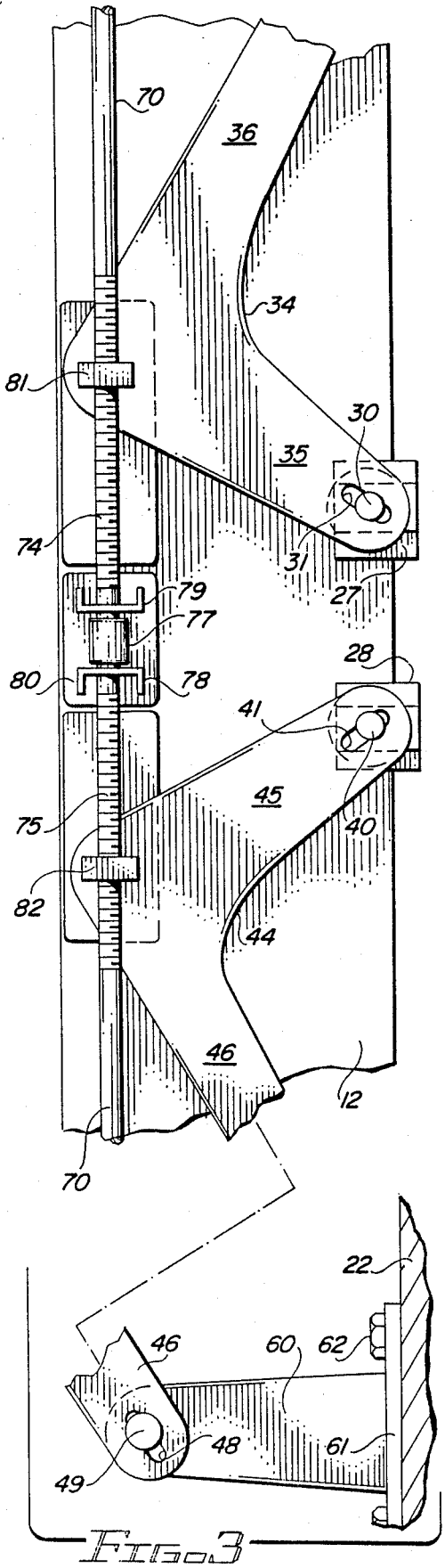
FIG. 3 is an enlarged detail showing portions of the mechanism of the embodiment shown in FIGS. 1 and 2.

A similar attachment is made of the ends of the longer arms 36 and 46 to a pair of outwardly extending mounting brackets 50 and 60 attached to the vertical member 22 of the window sash. The relative spacing of the brackets 50 and 60 is shown most clearly in FIG. 2. FIGS. 3 and 6 illustrate in detail the manner of attachment of the lower bracket 60. As shown in FIG. 3, this bracket 60 extends outwardly from a mounting plate 61 which is attached to the vertical member 22 of the sash by means of screws or bolts 62. A pivot pin 49 passes through an elongated slot 48 in the end of the lever arm 46, and the pin 49 is attached in any suitable manner to the end of the bracket 60. The long legs 36 and 46 pivot and slide about the pivot pins 39 and 49 through the mounting slots 38 and 48 as the window mechanism is operated to open and close the window.

The mechanism which is used to pivot the lever arms 34 and 44 from the position shown in FIG. 1 through a variety of intermediate positions to the position shown in FIG. 2, and back again, is illustrated in detail in FIGS. 3, 4, 5, and 6. The elbows of each of the operating levers 34 and 44 have a hole (not shown) in them which directly underlies a pair of follower nuts 81 and 82 having pivot pin extensions 37 and 47, respectively, which engage the holes in the elbows of the operating lever members 34 and 44. These follower nuts are mounted on threaded portions 74 and 75, respectively, on an operating rod 70 which extends from the bottom to the top of the window frame adjacent the side member 12. At the top end, the rod 70 extends into a cup bearing 72, which extends into a hole 73 in the top horizontal cross member 11 of the window frame. The details of this structure are shown most clearly in FIGS. 4 and 6.

At the bottom end, the rod 70 terminates in a bevel gear 90 which engages another bevel gear 91 at right angles to it. The bevel gear 91 in turn is connected to a rod 93 which terminates in its opposite end in another bevel gear 95. The gear 95 is located (as shown in FIG. 5) beneath a similar vertical operating rod 99 on the opposite side of the window frame for operating a mechanism which is the duplicate of the one shown in Figs. 1, 2, 3 and 6, but located on the other side of the window. A bevel gear 96 then is attached to a crank 97 extending outwardly into the room. When the crank 97 is rotated in either direction, the gear arrangements, which have been illustrated, rotate the rods 70 and 99 in one or the other of two directions to either move the follower nuts 81 and 82 on the rods 70 and 99 closer together or further apart.

Support for the operating mechanism is provided at the center of the vertical rods 70 and 99 by means of a central connector member 77. This member interconnects the top and bottom sections of the rod 70 between a pair of bearing blocks 78 and 79 attached to a plate 80. The plate 80 is fastened to the frame member 12 in any suitable manner, so that the rod 70 is firmly held in place adjacent the location of the operation of the levers 34 and 44. The pitch of the threads of the threaded portions 74 and 75 on opposite sides of the central connector 77 is in opposite directions; so that when the rod 70 is rotated in a first direction, the follower nuts 81 and 82 move toward one another; and when the rod 70 is rotated in the opposite direction, the follower nuts 81 and 82 move away from one another. When the elbows of the levers 34 and 44 are moved toward and away from one another in a vertical line parallel to the rod 70 by means of the pins 37 and 47, the relative locations of the pivot pins 40 and 49 in the slots 41 and 48, and of the pivot pins 30 and 39 in the slots 31 and 38, change to accomodate the changes in distances of the triangles formed as a result of the structure which has been illustrated. The lengths of the slots 31, 38 and 41 and 48 are selected to to be sufficient to allow for this relatively small dimensional change. The slots, however, or their equivalents are necessary to prevent binding of the various parts when the window is moved from its closed to its open position.

It should be noted that the mechanism which is shown in detail in FIGS. 1 through 4 and 6 is duplicated exactly in a mirror image on the opposite window frame (not shown) operated through the operating rod 99. With the apparatus shown in FIG. 5, a single crank 97 is used to rotate both of the rods 70 and 99 to open and close the window through an identical and parallel action on both sides. The result is movement of the window sash 20, 21, and 22 toward and away from the opening in the frame in a plane parallel to the frame throughout all positions from fully closed to fully open.

FIGS. 7 and 8 illustrate an alternative embodiment which may be employed to perform a function of opening both sides of the window in precisely the same amounts as is accomplished with the mechanism of FIG. 5 described above, or, alternatively, for opening one or the other side of the window while leaving the opposite side closed. To accomplish this, the crank 97 is located at the center of the bottom horizontal member 10 of the window frame. A pair of bevel gears 101 and 105 then engage opposite sides of the operating bevel gear 95 on the end of the crank 97 for rotation by the gear 95. The gears 101 and 105, however, in turn are mounted on spring loaded extensions 112 and 122, respectively, which normally are biased into engagement with the gear 95 by means of a spring 115 located within a housing 110 and a similar spring located within a housing 120.

In FIG. 7, the fully extended position of the spring 115 and the rectangular shaft 112 to engage the gear 101 with the gear 95 is illustrated. On the opposite side, however, the shaft 122 is shown in its retracted position within the housing 120. To determine the position of the gears 101 and 105, operating levers 113 and 123, respectively, are attached to the tops of the shafts 112 and 122. These levers then are movable within L-shaped slots (shown in dotted lines) located in the frame or in a separate piece of hardware located adjacent the lower frame member 10 of the window frame. In the position shown for the lever 113, the corresponding bevel gear 101 is engaged with the gear 95. In the open or unlocked position shown for the lever 123, the corresponding bevel gear 105 is disengaged from the bevel gear 95 on the crank.

When one or the other of the gears 101 or 105 is disengaged, operation of the crank 97 causes corresponding operation of the operating lever members 34 and 44 on one side only of the window. The window is pivoted outwardly on one edge, much in the manner of a casement window, in this mode of operation. This can be accomplished for either side at the option of the user when the variation of FIG. 7 is employed. Alternatively, when both of the levers 113 and 123 are in the position shown in solid lines for the lever 113, both sides of the window are operated together in the same manner as described above in conjunction with the operation of the mechanism of FIG. 5.

It also is possible to provide an additional securing or locking of the window to prevent rotation of the crank 97 or any other rotation of any of the rods 70, 99 and the like. This can be accomplished by means of an extension 106, for example, on the end of the operating rod 93 past the end of the bevel gear 91. A hole 107 is provided in this extension 106 and the hole may be engaged by a spring activated locking pin or the like. Other types of locking devices may be used, but the one shown in FIG. 7 illustrates a general technique which may be employed, if an additional locking capability for the window opening mechanism is desired.

The foregoing description of the preferred embodiments of the invention should be considered as illustrative only and not as limiting. Various changes and modifications will occur to those skilled in the art without departing from the true scope of the invention defined by the appended claims.

I claim:

1. A window opening mechanism for moving a window sash outwardly from a window frame, said mechanism including in combination;

first and second L-shaped operating lever members each having one relatively short leg and one substantially longer leg connected together at an elbow and each having a free end;

first connecting means for pivotally and slideably connecting the free ends of the short legs of said first and second lever members to the window frame a first distance apart;

second connecting means for pivotally connecting the free ends of the longer legs of said first and second lever members to the window sash a second predetermined distance apart, said second predetermined distance being greater than said first distance;

drive point means connected at a single point to the elbows of each of said first and second lever members; and first drive means including a rotatable rod, having an axis thereof which is parallel to a side of the window frame, mounted on the frame for rotation in either direction, said rod including first and second oppositely turned threaded portions on either side of an intermediate point, with first and second threaded follower nuts respectively engaging said first and second threaded portions and further engaging said drive point means on the elbows of said first and second lever members, the elbows of said lever members being moved toward and away from one another along a straight line by said follower nuts in accordance with the direction of rotation of said rotatable rod to correspondingly move the window sash toward and away from the window frame.

2. The combination according to claim 1 further including means for rotating said rotatable rod.

3. The combination according to claim 2 wherein said means for rotating said rotatable rod includes a crank member.

4. The combination according to claim 3 wherein said crank member comprises a manual crank.

5. The combination according to claim 2 wherein said means for rotating said rotatable rod comprises a bearing mounted on said frame for receiving one end of said rotatable rod, a first gear means connected to the other end of said rotatable rod, a second gear means connected to a crank member extending substantially 90° to said rotatable rod for rotation in first and second opposite directions to engage said first gear means and correspondingly rotate said rotatable rod in first and second opposite directions.

6. The combination according to claim 1 wherein an aperture is provided through the longer legs of said lever members near the free ends thereof, and said means for pivotally connecting the ends of the longer legs of said lever members to the sash includes separate bracket members for each such connection, with said bracket members each having an extension in a plane perpendicular to the plane of the window sash extending toward the window frame and each having a pivot pin attached thereto, each said pin passing through the aperture in the end of the corresponding longer leg of said lever members, the axes of all of said pivot pins being parallel to the plane of said window sash.

7. The combination according to claim 1 wherein said window sash is a rectangular sash having first and second opposite sides and said window frame is a rectangular frame also having first and second opposite sides, and wherein said first and second L-shaped lever members are connected between the first side of said window frame and the first side of said window sash, and further including;

third and fourth L-shaped lever members, each having one relatively short leg and one substantially longer leg connected together at an elbow and each having a free end;

third connecting means for pivotally and slideably connecting the free ends of the short legs of said third and fourth lever members to the second side of said window frame said first distance apart;

fourth connecting means for pivotally connecting the free ends of the longer legs of said third and fourth lever members to the second side of said sash said second predetermined distance apart;

further pivot drive point means on the elbows of said third and fourth lever members; and second drive means including a second rotatable rod, having an axis thereof which is parallel to the second side of the window frame, mounted on the second side of the frame for rotation in either direction, said second rod including first and second oppositely turned threaded portions on either side of an intermediate point, with third and fourth threaded follower nuts respectively engaging said first and second threaded portions of said second rod and further engaging said drive point means on the elbows of said third and fourth lever members, the elbows of said third and fourth lever members being moved toward and away from one another along a straight line by said follower nuts in accordance with the direction of rotation of said rotatable rod to correspondingly move the second side of the sash toward and away from the second side of the window frame parallel with the first side of said sash.

8. The combination according to claim 7 wherein said first, second, third and fourth lever members all have identical dimensions with said first and second lever members being mounted as mirror images of one another and said third and fourth lever members being mounted as mirror images of one another.

9. A window opening mechanism for moving a rectangular window sash outwardly from a rectangular window frame, said sash having first and second opposite sides and said frame having first and second opposite sides, said mechanism including in combination;

first and second L-shaped operating lever members each having one relatively short leg and one substantially longer leg connected together at an elbow and each leg having a free end;

first connecting means for pivotally and slideably connecting the free ends of the short legs of said first and second lever members to the first side of the window frame at a first distance apart;

second connecting means for pivotally connecting the free ends of the longer legs of said first and second lever members to the first side of the window sash a second predetermined distance apart, said second predetermined distance being greater than said first distance;

first drive means connected to the elbows of said first and second lever members for moving said elbows toward and away from one another along a straight line to correspondingly move the window sash toward and away from the window frame;

third and fourth L-shaped lever members, each one having one relatively short leg and one substantially longer leg connected together at an elbow and each having a free end;

third connecting means for pivotally and slideably connecting the free ends of the short legs of said third and fourth lever members to the second side of the window frame said first distance apart;

fourth connecting means for pivotally connecting the free ends of the longer legs of said third and fourth lever members to the second side of the window sash said second predetermined distance apart; and second drive means connected to the elbows of said third and fourth lever members for moving the elbows of said third and fourth lever members toward and away from one another along a straight line to correspondingly move the second side of the sash toward and away from the second side of the window frame;

said first, second, third and fourth lever members all have identical dimensions, with said first and second lever members being mounted as mirror images of one another and said third and fourth lever members being mounted as mirror images of one another; and means for selectively operating said first and second drive means together and independently of one another.

10. The combination according to claim 9 wherein an aperture is provided through the longer legs of said lever members near the free ends thereof, and said means for pivotally connecting the ends of the longer legs of said lever members to the sash includes separate bracket members for each such connection, with said bracket members each having an extension in a plane perpendicular to the plane of the window sash extending toward the window frame and each having a pivot pin attached thereto, each said pin passing through the aperture in the end of the corresponding longer leg of said lever members, the axes of all of said pivot pins being parallel to the plane of said window sash.

* * * * *